US007891647B2

(12) United States Patent
Nakane et al.

(10) Patent No.: US 7,891,647 B2
(45) Date of Patent: Feb. 22, 2011

(54) SHEET PROCESSING APPARATUS AND IMAGE FORMING SYSTEM

(75) Inventors: Yoshimitsu Nakane, Ryugasaki (JP); Yuji Yamanaka, Toride (JP); Wataru Kawata, Kashiwa (JP); Seiichiro Adachi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 428 days.

(21) Appl. No.: 12/105,557

(22) Filed: Apr. 18, 2008

(65) Prior Publication Data

US 2008/0258372 A1 Oct. 23, 2008

(30) Foreign Application Priority Data

Apr. 20, 2007 (JP) ..... 2007-111304
Apr. 1, 2008 (JP) ..... 2008-095500

(51) Int. Cl.
*B65H 37/04* (2006.01)

(52) U.S. Cl. ..... 270/52.09; 270/5.02; 270/6; 270/7; 270/8; 270/9; 270/10; 270/11; 270/12; 270/13; 270/15; 270/17; 270/19; 270/20.1; 270/21.1; 270/37; 270/52.07; 270/52.08; 270/58.08; 270/43; 270/44; 270/45; 270/47; 270/51; 270/58.07

(58) Field of Classification Search ..... 270/5.02, 270/6, 7, 8, 9, 10, 11, 12, 13, 14, 15, 17, 270/19, 21.1, 37, 52.07, 52.08, 52.09, 43, 270/44, 45, 47, 51, 58.07, 58.08
See application file for complete search history.

(56) References Cited

U.S. PATENT DOCUMENTS 3,955,750 A * 5/1976 Huffman ..... 229/69
4,179,107 A * 12/1979 Harris ..... 270/4
5,065,992 A 11/1991 Crowley et al.
5,138,821 A 8/1992 Crowley et al.
5,520,378 A * 5/1996 Kepert et al. ..... 270/8
5,704,602 A * 1/1998 Taylor et al. ..... 270/1.02
6,383,124 B1 * 5/2002 St. Germain et al. ..... 493/353

FOREIGN PATENT DOCUMENTS

JP 59-150797 8/1984
JP 07-101181 4/1995

* cited by examiner

*Primary Examiner*—Leslie A Nicholson, III
(74) *Attorney, Agent, or Firm*—Canon USA Inc IP Division

(57) ABSTRACT

A sheet processing apparatus includes a winding unit configured to wind a continuous sheet, a binding unit configured to bind the continuous sheet that is wound and stacked by the winding unit, and a first cutting unit configured to cut the continuous sheet that is bound by the binding unit in a state that the continuous sheet is wound by the winding unit.

15 Claims, 12 Drawing Sheets

PRIOR ART

SHEET PROCESSING APPARATUS AND IMAGE FORMING SYSTEM

BACKGROUND OF THE INVENTION

1. Field of the Invention

The present invention relates to sheet processing apparatus and image forming system.

2. Description of the Related Art

Conventionally, there is an image forming system that includes an image forming apparatus such as a copying machine or a laser beam printer, and a sheet processing apparatus. Such a sheet processing apparatus takes in a sheet that is discharged after the image forming apparatus forms an image on the sheet and performs a bookbinding process. For example, sheets are folded in the middle or bound approximately at the center of the sheet and folded in two in a bookbinding process.

A conventional image forming apparatus can improve a throughput by shortening the distance between the sheets. For example, there is an image forming apparatus which continuously forms images at predetermined intervals on a continuous sheet in which there is no interval between the sheets that are rolled out from a sheet roll.

Moreover, there is a sheet processing apparatus which performs a process after winding a continuous sheet on which images are formed into a roll (refer to U.S. Pat. No. 5,138,821). Further, there is a sheet processing apparatus that performs a process after stacking the sheets on which images are formed into a z-shaped pattern (refer to U.S. Pat. No. 5,065,992).

FIG. 12 illustrates an example of a conventional sheet processing apparatus which inserts a continuous sheet that is wound into a roll after images are continuously formed on the sheet into envelopes.

Referring to FIG. 12, an envelope roll 34 rolls up open envelopes 58, and three sheet rolls 28 roll up continuous sheets on which images are continuously formed. A cutting unit 40 cuts the continuous sheet. A folding unit 50 folds the sheet cut by the cutting unit 50, an inserting unit 52 inserts sheets folded by the folding unit into the envelopes 58, and a central processing unit (CPU) 54 controls operations of such a sheet processing apparatus.

In a case where the sheet processing apparatus inserts sheets on which images are formed into the open envelopes 58, continuous sheets are each sent out from the three sheet rolls 28 and cut by the cutting unit 40. The folding unit 50 folds the cut sheets, and the inserting unit 52 inserts the folded sheets into the envelopes 58.

The above-described conventional sheet processing apparatus can also cut a continuous sheet that is wrapped around a sheet roll and bind the cut sheets. However, it takes time to cut the sheets one by one from a continuous sheet and stack the sheets again to bind the sheets. Moreover, such a sheet processing apparatus needs a stapling unit, a double folding unit, and a cutting unit which cuts edges of a double folded sheet bundle instead of the inserting unit 52.

A sheet processing apparatus which includes a stapling unit, a double folding unit, and a cutting unit as described above can perform a binding process. However, since a double folding process, a stapling process, and a cutting process are separate processes, the binding process takes a long time, and productivity decreases. Further, an amount of cutting wastage and consumption of the sheet roll increase if a cutting amount of edges of a double folded sheet bundle increases.

SUMMARY OF THE INVENTION

The present invention is directed to a sheet processing apparatus and an image forming apparatus that can improve productivity and decrease an amount of cutting.

According to an aspect of the present invention, a sheet processing apparatus includes a winding unit configured to wind a continuous sheet, a binding unit configured to bind the continuous sheet that is wound and stacked by the winding unit, and a cutting unit configured to cut the continuous sheet that is bound by the binding unit in a state that the continuous sheet is wound by the winding unit.

According to an exemplary embodiment of the present invention, productivity can be improved by cutting a continuous sheet that is wound by a winding unit and stacked.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
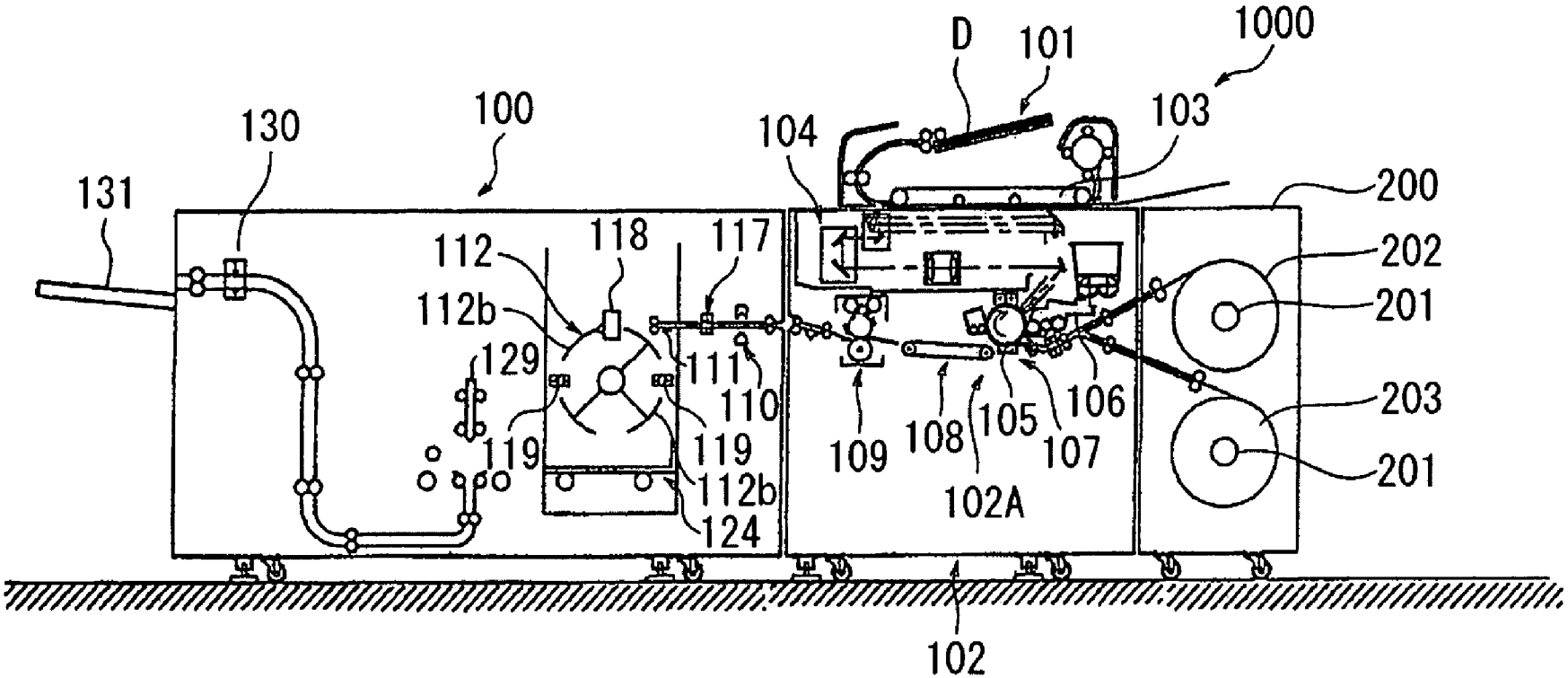
FIG. 1 illustrates an example configuration of an image forming system including an image forming apparatus and a sheet processing apparatus according to an exemplary embodiment of the present invention.

FIG. 1 illustrates an example configuration of an image forming system including an image forming apparatus and a sheet processing apparatus according to an exemplary embodiment of the present invention. Referring to FIG. 1, an image forming apparatus 1000 includes an image forming apparatus main body 102, a scanner 104 disposed on a top surface of the image forming apparatus main body 102, and a bookbinding apparatus 100 that is a sheet processing apparatus. Further, the image forming apparatus 1000 includes a roll sheet feeding apparatus 200 that supplies a continuous sheet to the image forming apparatus main body 102.

The scanner 104 reads an original image (not illustrated) which is placed on top of a platen glass 103, or an original D which is conveyed onto the platen glass 103 by an automatic document feeder 101. The image forming apparatus main body 102 includes an image forming portion 102A that includes for example a photosensitive drum 105, and forms an image according to the original image read by the scanner 104.

Sheet rolls 202, 203 are image formed sheets on one surface that are wrapped around roll core members 201 and are positioned one above the other in the roll sheet feeding apparatus 200. The roll core member 201 of the upper sheet roll 202 rotates to feed a continuous sheet to the image forming apparatus main body 102. When the upper sheet roll 202 runs out, a continuous sheet is fed to the image forming apparatus main body 102 from the lower sheet roll 203.

An image forming operation of the image forming apparatus main body 102 will be described below. When the image forming apparatus main body 102 starts an image forming operation, the photosensitive drum 105 whose outer surface is charged rotates in the direction of the arrow. The scanner 104 then irradiates the original D placed on top of the platen glass 103. Light reflected from the original D is radiated on the photosensitive drum 105, and an electrostatic latent image is formed on the photosensitive drum 105. The electrostatic latent image is developed by a developer 106 and visualized as a toner image.

In parallel with the above-described toner image forming operation, the roll sheet feeding apparatus 200 feeds a continuous sheet at predetermined timing to the image forming apparatus main body 102. The continuous sheet is conveyed to a transfer unit 107 so as to match a leading edge of the toner image formed on the outer surface of the photosensitive drum 105. As a result, the toner image formed on the outer surface of the photosensitive drum 105 is transferred onto an opposite surface of the image formed surface of the continuous sheet that is conveyed to the transfer unit 107. In the present exemplary embodiment, an image formed continuous sheet on one surface is conveyed to the transfer unit 107, and the toner image is formed on the opposite surface of the image formed surface. However, two facing image forming portions can be provided so that images formed both surfaces of the continuous sheet. By either both of the methods, a booklet can be produced in order of page.

A conveying unit 108 conveys the continuous sheet on which the toner image is transferred to a fixing unit 109, and the fixing unit 109 fixes the toner image on the continuous sheet. The image forming apparatus main body 102 repeats the image forming operation to continuously form images at an interval of a predetermined length on the upper surface of the continuous sheet. The continuous sheet on which toner images are continuously formed at the interval of the predetermined length is discharged onto the bookbinding apparatus 100. After a length of the continuous sheet that equals the number of sheets to be bound is conveyed to the book binding apparatus 100, a cutter 117 cuts a rear end of the continuous sheet.

The bookbinding apparatus 100 which receives from the image forming apparatus main body 102 the continuous sheet on which images are continuously formed at the interval of the predetermined length includes a scoring device 110, the above-described cutter 117, and a drum 112. Further, the bookbinding apparatus 100 includes a stapler 118, a sheet bundle cutting device 119, a stacking portion 124, a folding portion 129, and a trimming device 130. In the present exemplary embodiment, the bookbinding apparatus 100 includes the cutter 117 and cuts the continuous sheet on which images have been formed into a length that equals the number of sheets to be bound. However, the cutter 117 can be included in the image forming apparatus main body 102, and the continuous sheet can be cut into a length that equals the number of sheets of a booklet to be produced before images are formed on the sheet.

Figure 2:
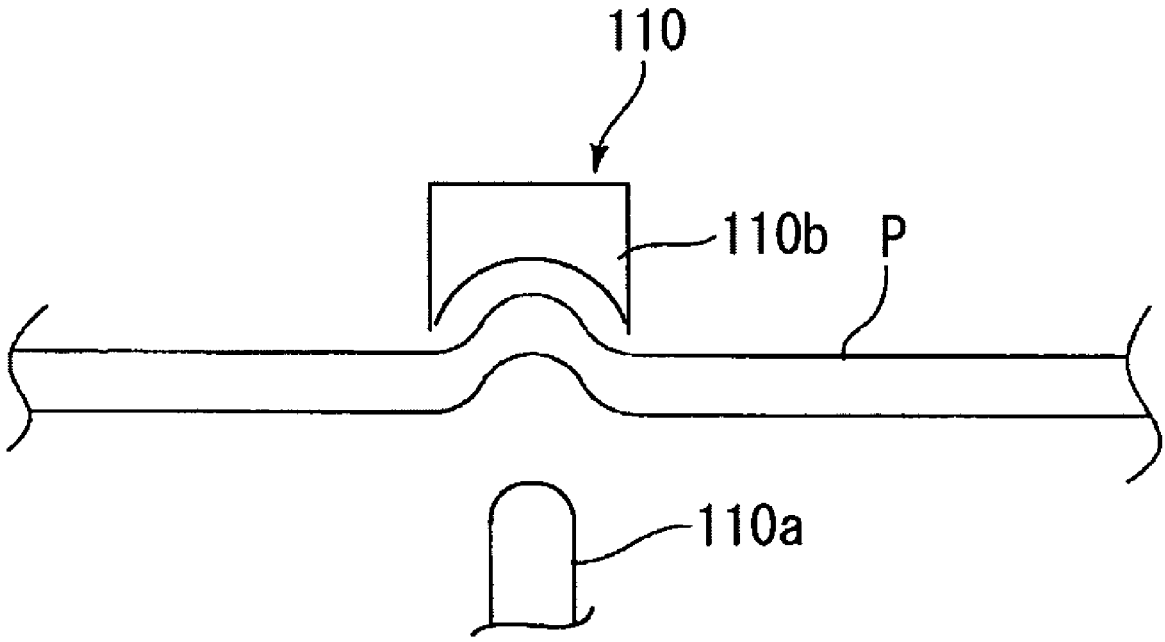
FIG. 2 illustrates an example configuration of a scoring device included in a bookbinding apparatus which is the sheet processing apparatus illustrated in FIG. 1 according to an exemplary embodiment of the present invention.

The scoring device 110 applies pressure on the continuous sheet and forms a grooved crease on the continuous sheet P as a folding portion as illustrated in FIG. 2. The scoring unit 110 includes a pushing member 110*a* which moves back and forth in a direction of thickness of the continuous sheet P, and a receiving member 110*b*. The above-described groove portion is formed between images on the continuous sheet P, so that a continuous sheet bundle can be smoothly and precisely folded, as will be described below.

Figure 7A:
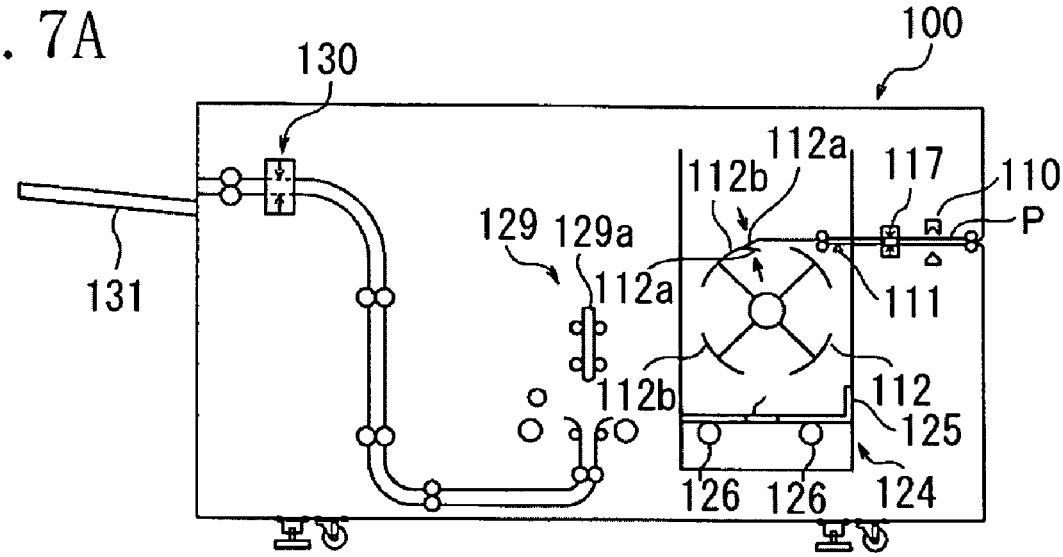
FIGS. 7A and 7B illustrate an example bookbinding operation performed by a bookbinding apparatus according to an exemplary embodiment of the present invention.
Figure 7B:
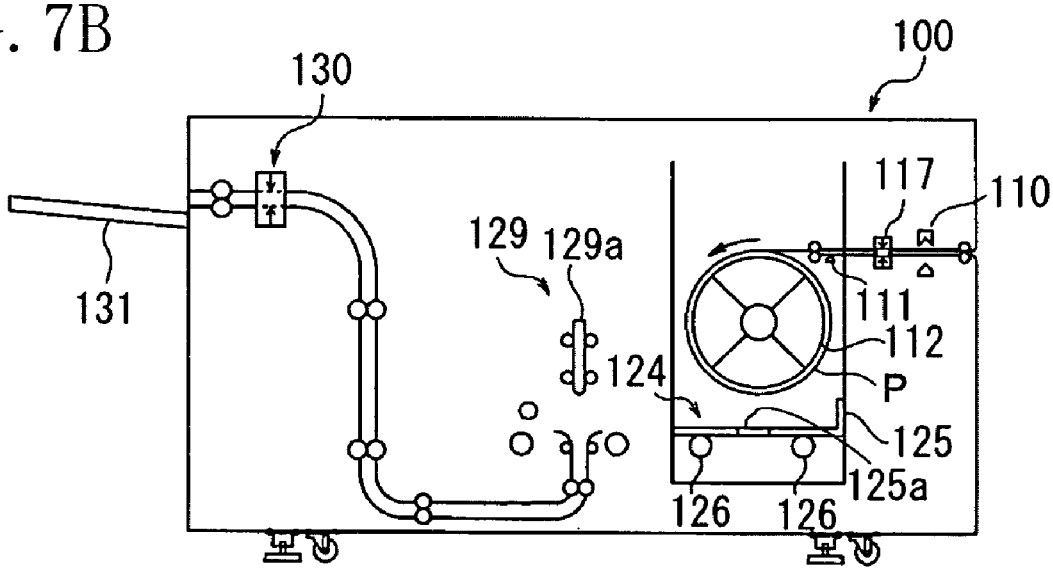

The drum 112 winds the continuous sheet on which groove portions are formed by the scoring device 110, to wrap the sheet around the periphery of the drum 112 for a predetermined number. The drum 112 includes a gripper 112*a* that grips a leading end of the sheet P as illustrated in FIGS. 7A and 7B. The drum 112 winds the continuous sheet by rotating while the gripper 112*a* grips the leading end of the continuous sheet.

An outer surface member 112*b* which configures the periphery of the drum 112 (i.e., a winding unit), is movable in a radial direction of the drum 112. Therefore, the outer diameter of the drum 112 can be adjusted according to the size of a bookbinding sheet which is to be output by the bookbinding apparatus 100. For example, if the bookbinding apparatus 100 is to form a large-size output, the outer surface member 112*b* is moved away from the center of the drum 112, so that the outer diameter of the drum 112 matches the size of the sheet.

The above-described continuous sheet tends to curl. However, the continuous sheet can be smoothly wound using the cylindrical drum 112. As a result, a sheet correction mechanism and energy to be applied to correct the sheet are not necessary, so that energy saving and noise-reduction can be realized.

The stapler 118 staples the continuous sheet stacked on the drum 112 at two opposed positions, i.e., positions that are 180 degrees shifted with each other. When the stapler 118 is not operating, the stapler 118 moves to a retracted position lateral to the drum 112 so that the stapler 118 does not prevent the drum 112 from winding the continuous sheet.

Figure 3:
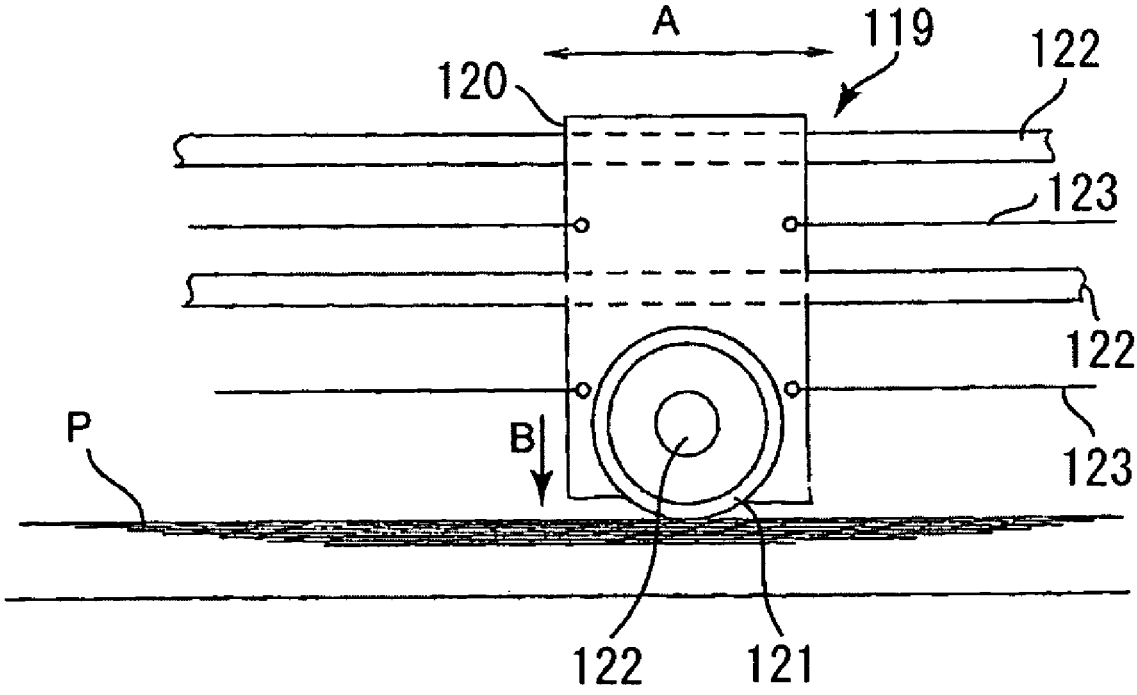
FIG. 3 illustrates an example configuration of a sheet bundle cutting device included in a bookbinding apparatus according to an exemplary embodiment of the present invention.

The sheet bundle cutting device 119 cuts the continuous sheet that is wrapped around the drum 112 in a bundle after the stapler 118 staples the continuous sheet. As illustrated in FIG. 3, the sheet bundle cutting device 119, namely a first cutting device includes a rotatable cutter 121 and a holder 120 that pivotally supports the cutter 121 via a shaft 122.

The holder 120 is movable in the direction of width of the continuous sheet P, i.e., in a direction perpendicular to the sheet conveying direction of the continuous sheet P that is indicated by the arrow A along the shaft 122. Further, wires 123 which are suspended between two pulleys (not illustrated) are fixed onto the holder 120. As a result, when the pulley driving motor (not illustrated) is driven, the sheet bundle cutting device 119 is moved in the direction indicated by the arrow A along the shaft 122.

Figure 4A:
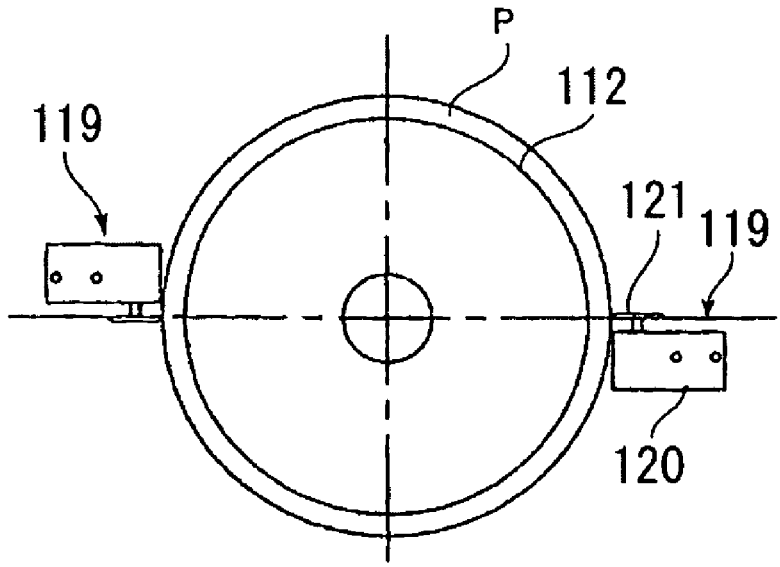
FIGS. 4A and 4B are example diagrams illustrating a sheet bundle cutting process performed by a sheet bundle cutting device according to an exemplary embodiment of the present invention.
Figure 4B:
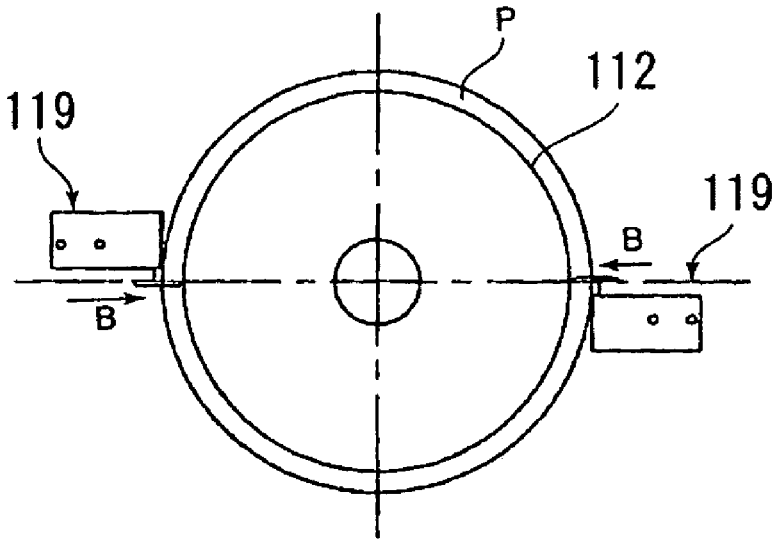

The sheet bundle cutting device 119 is generally in a standby position lateral to the drum 112, as illustrated in FIG. 4A. When cutting a sheet bundle, the sheet bundle cutting device 119 moves in the direction of the width of the drum 112 according to the motion of the pulley driving motor. In such a case, the sheet bundle cutting device 119 causes the cutter 121 to rotate and move toward the drum 112 as indicated by the arrow B illustrated in FIG. 4B and FIG. 3. As a result, the sheet bundle cutting device 119 can cut a bundle of the continuous sheet P which is wrapped around the drum 112 at two opposed positions that are 90 degrees shifted from the positions stapled by the stapler 118.

Consequently, the continuous sheet that is stapled by the stapler 118 at positions that are 180 degrees shifted from each other is separated into two sheet bundles. Further, the portion of the continuous sheet that is positioned at the lower side of the drum 112 drops as a sheet bundle that is stapled at the center. As described above, the continuous sheet which is stapled by the stapler 118 can be cut at intervals between the images that are continuously formed at a minimal distance. Further, alignment of the continuous sheet is kept even if the continuous sheet is dropped after cutting.

In the present exemplary embodiment, the continuous sheet P wrapped around the drum 112 is stapled at two positions and cut at two positions. However, the position at which the continuous sheet is stapled or cut is not limited to the above-described positions. For example, if a long sheet bundle is desirable, the continuous sheet can be stapled and cut at one position. Further, the continuous sheet can be stapled and cut at three or more positions so that three or more sheet bundles can be formed at once. Further, an end binding sheet bundle can be formed by binding an edge of the sheet bundle and omitting the folding process which is described below.

The stacking portion 124 is disposed below the drum 112 as illustrated in FIG. 1. The stacking portion 124 stacks a sheet bundle dropped from the drum 112 by cutting the continuous sheet with the sheet bundle cutting device 119.

The stacking portion 124 is set on an upper surface of a dolly 125 that is equipped with wheels 126 as illustrated in FIGS. 7A and 7B. After the sheet bundle is stacked onto the stacking portion 124, the dolly 125 is moved, so that the sheet bundle can be conveyed to the folding portion 129. There is a rectangle hole 125*a* at the center of the stacking portion 124.

The sheet bundle conveyed by the dolly 125 is folded in two by the folding portion 129. The folding portion 129 includes a pushing rod 129*a* used to push the center of the sheet bundle into the rectangle hole 125*a* in the center of the stacking portion 124 as illustrated in FIGS. 7A and 7B. By pushing the pushing member 129*a* into the rectangle hole 125*a*, the sheet bundle which is stacked on the stacking portion 124 with the binding position at the center, is bent downwards and folded.

The trimming device 130 is set downstream from the folding portion 129. The trimming device 130, namely a trimming unit trims a rear end, namely an edge on the opposite side of the stapled position of the sheet bundle that is folded in two by the folding portion 129. Referring to FIG. 1, a sheet detection sensor 111 detects the leading end of the sheet.

Figure 5:
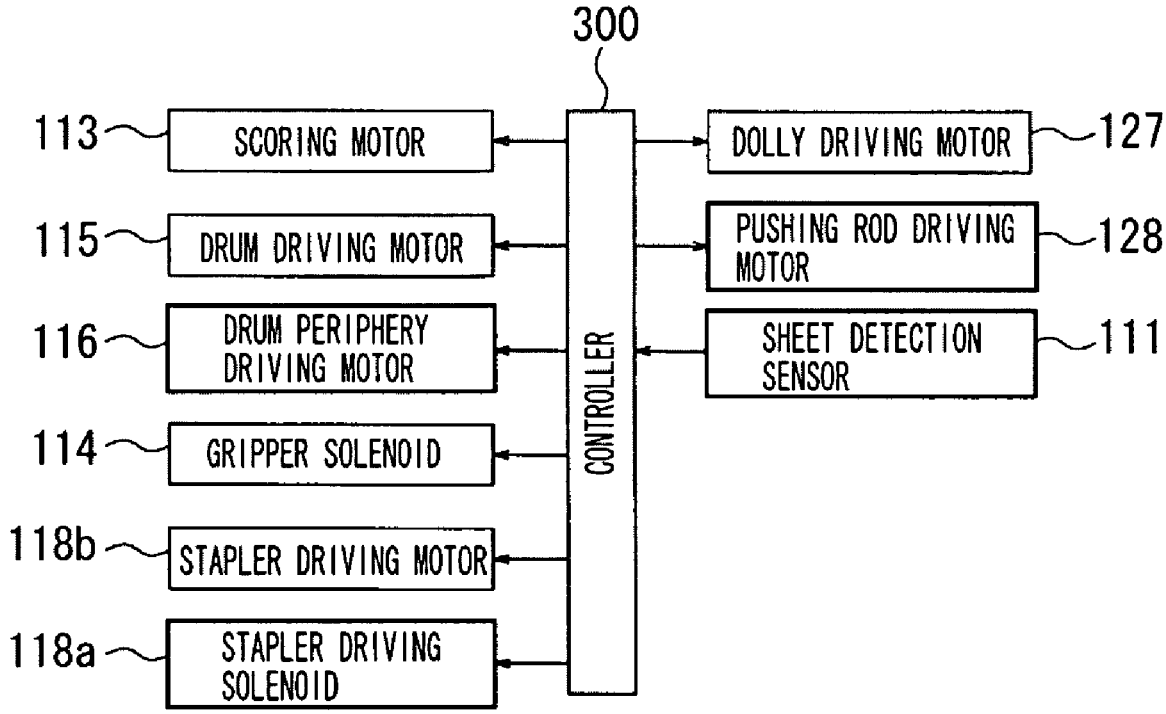
FIG. 5 illustrates an example block diagram of a bookbinding apparatus according to an exemplary embodiment of the present invention.

FIG. 5 is an example control block diagram of the above-described bookbinding apparatus 100. Referring to FIG. 5, a controller 300 controls a bookbinding process of the bookbinding apparatus 100. The controller 300 is included in the bookbinding apparatus 100 or the image forming apparatus main body 102.

The controller 300 controls a scoring motor 113 that moves back and forth the pushing member 110*a* of the scoring apparatus 110, and a drum driving motor 115 that rotates the drum 112. Further, the controller 300 controls a gripper solenoid 114 that causes the gripper 112*a* set on the drum 112 to operate, and a drum periphery driving motor 116 that moves the outer surface member 112*b* which configures the periphery of the drum 112 in the radial direction of the drum 112.

Further, the controller 300 controls a dolly driving motor 127 that drives the wheels 126 for moving the dolly 125, and a pushing rod driving motor 128 that drives the pushing rod 129*a* of the folding portion 129. Further, the controller 300 controls a stapler driving motor 118*b* that moves the stapler 118 between a retracting position and an operating position, and a stapler driving solenoid 118*a* that drives the stapler 118.

Figure 6:
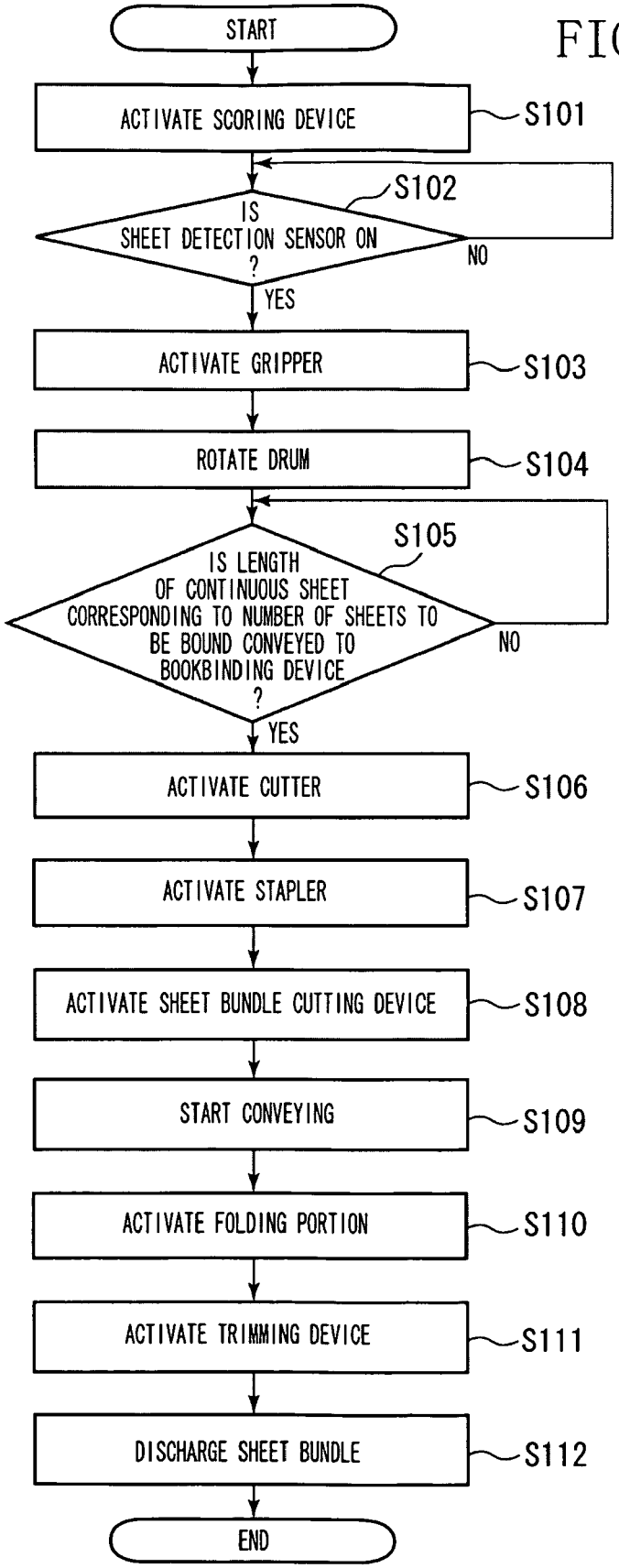
FIG. 6 illustrates an example flowchart based on a bookbinding control process performed by a bookbinding apparatus according to an exemplary embodiment of the present invention.

A bookbinding control process of the bookbinding apparatus 100 will be described below with reference to the flowchart illustrated in FIG. 6.

A continuous sheet P on which continuous images are formed by the image forming apparatus main body 102 enters the bookbinding apparatus 100 as illustrated in FIG. 7A. In step S101, the controller 300 activates the scoring device 110. Consequently, the scoring motor 113 is driven (see FIG. 5), so that the pushing member 110*a* in the scoring device 110 moves toward the continuous sheet P to apply pressure on the continuous sheet P. As a result, a groove portion is formed on the continuous sheet P as a folding portion, as illustrated in FIG. 2. The groove portion is successively formed between the continuous images on the continuous sheet P.

In step S102, if the sheet detection sensor 111 detects a leading end of the continuous sheet P and is activated (YES in step S102), the controller 300 stops conveying the continuous sheet when the continuous sheet P runs into the gripper 112*a* inside the drum 112 according to a detection signal from the detection sensor 111. In step S103, the controller 300 applies voltage on the gripper solenoid 114 and activates the gripper 112*a*. As a result, the continuous sheet P is gripped by the gripper 112*a* which moves in the direction of the arrow illustrated in FIG. 7A.

In step S104, the controller 300 drives the drum driving motor 115 (see FIG. 5), and rotates the drum 112 while the gripper 112*a* grips the leading end of the continuous sheet P. As a result, as illustrated in FIG. 7B, the continuous sheet P is wrapped around the drum 112 a predetermined number of times, i.e., a length that equals the number of sheets of a booklet to be produced. The outer diameter of the drum 112 is adjusted to match the size of the output result (i.e., bookbinding sheets).

In step S105, if the continuous sheet P is conveyed for a length that can be wrapped around the drum 112 a predetermined number of times, i.e., a length that equals the number of sheets to be bound to the bookbinding apparatus 100 (YES in step S105), the process proceeds to step S106. In step S106, the controller 300 activates the cutter 117, and the cutter 117 cuts the rear end of the continuous sheet P. As a result, the length of the continuous sheet P that equals the number of sheets to be bound is wrapped around the drum 112, and conveyance of the continuous sheet P is temporarily stopped.

Figure 8A:
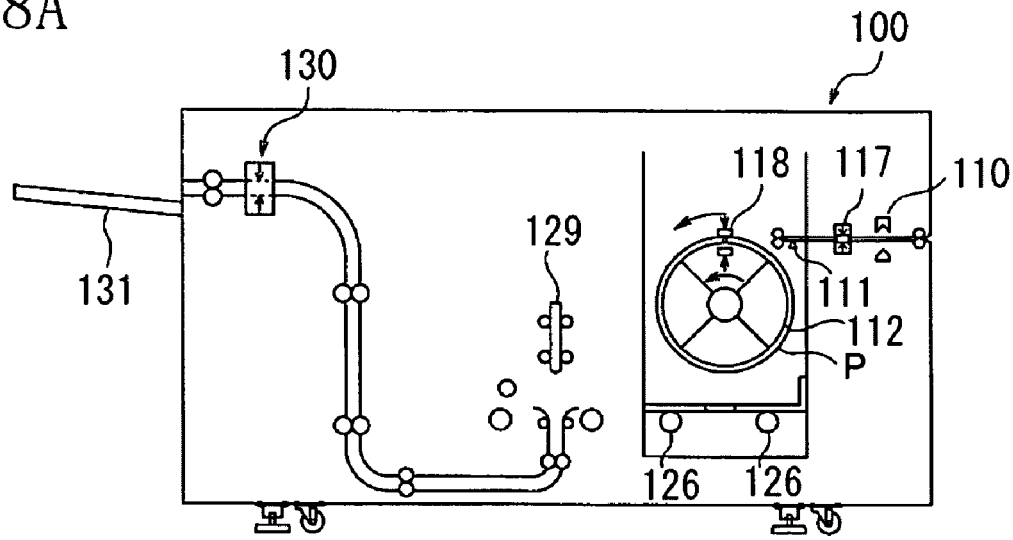
FIGS. 8A and 8B illustrate an example bookbinding operation performed by a bookbinding apparatus according to an exemplary embodiment of the present invention.

In step S107, the controller 300 activates the stapler 118. As a result, the stapler driving motor 118*b* (see FIG. 5) is driven, and the stapler 118 is moved from a retracting position to a predetermined operating position as illustrated in FIG. 8A. The stapler driving solenoid 118*a* (see FIG. 5) is activated at this position and staples the bundled continuous sheet P at two positions in the direction of the width of the continuous sheet P.

Further, the controller 300 rotates the drum 112 by 180 degrees, and the stapler 118 again staples at two positions in the width direction. Instead of rotating the drum 112, the stapler 118 can be rotated 180 degrees around the drum 112 and staple the continuous sheet P.

Figure 8B:
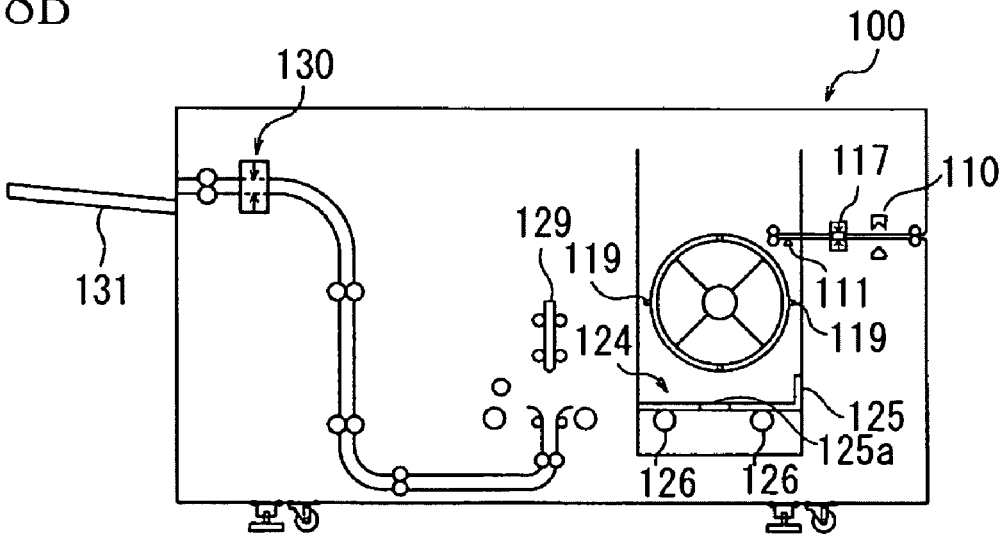

After the continuous sheet P is stapled at positions shifted 180 degrees by the stapler 118, in step S108, the controller 300 activates the sheet bundle cutting device 119 illustrated in FIG. 8B. The sheet bundle cutting device 119 cuts the continuous sheet P at two opposing positions that are located midway between the two stapled positions, i.e., positions that are 90 degrees shifted from the stapled positions. As a result, the continuous sheet P wrapped around the drum 112 is separated into two sheet bundles. Further, the sheet bundle that is positioned at the lower portion of the drum 112 and stapled at the center is dropped.

Figure 9A:
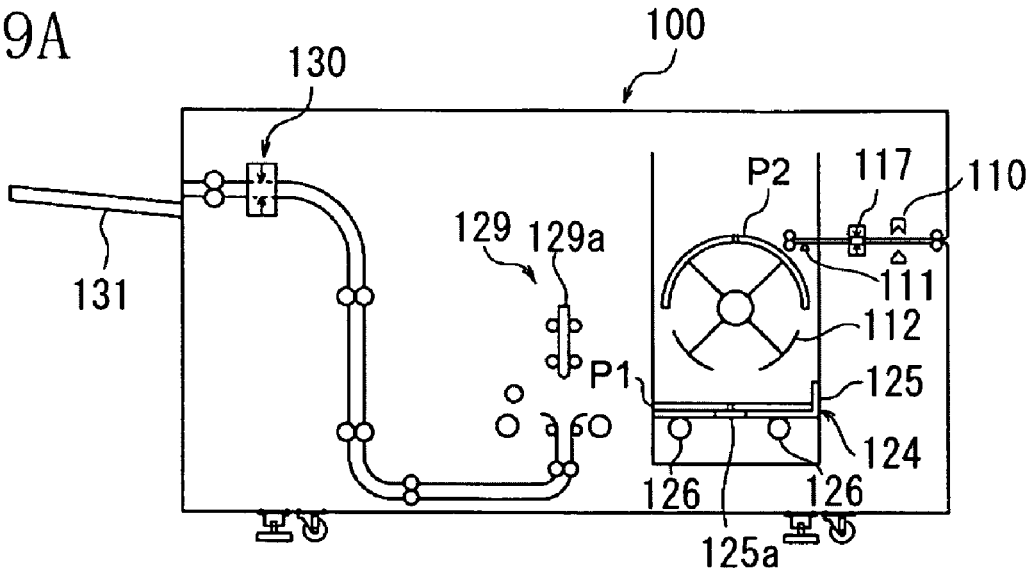
FIGS. 9A and 9B illustrate an example bookbinding operation performed by a bookbinding apparatus according to an exemplary embodiment of the present invention.
Figure 9B:
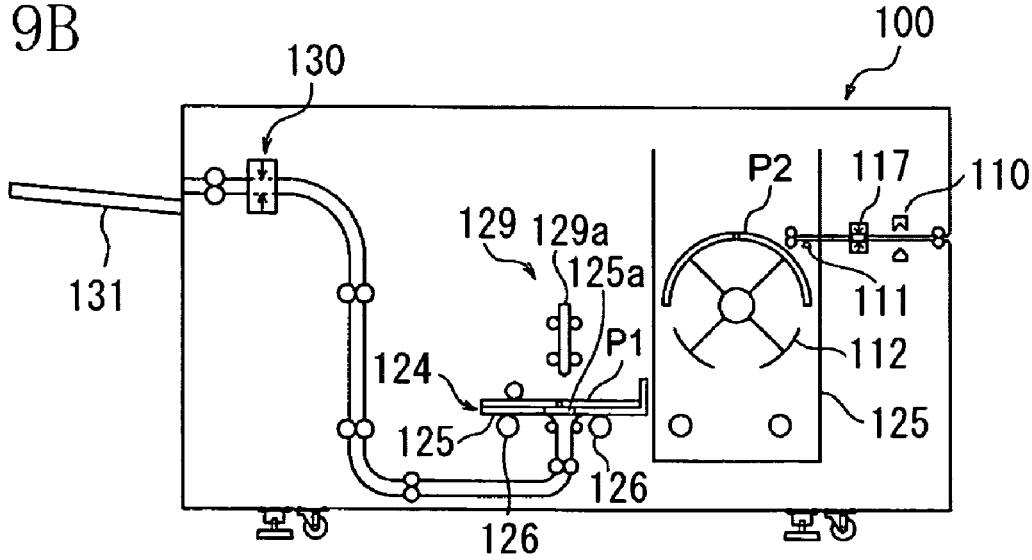

In step S109, the controller 300 starts conveying a sheet bundle P1, illustrated in FIG. 9A, which is the sheet bundle dropped from the drum 112 onto the stacking portion 124 on top of the dolly 125.

The dolly driving motor 127 (see FIG. 5) is driven to rotate the wheels 126. The sheet bundle P1 stacked on the stacking portion 124 is then conveyed to a position where the rectangle hole 125*a* in the center of the stacking portion 124 approaches the pushing rod 129*a* of the folding portion 129. The sheet bundle P1 formed by the sheet bundle cutting device 119 is stacked on the stacking portion 124 so that the stapling position of the sheet bundle P1 is aligned with the rectangle hole 125*a* in the center of the stacking portion 124.

In step S110, the controller 300 activates the folding portion 129. The pushing rod activating motor 128 is then activated, and the pushing rod 129*a* is pushed into the rectangle hole 125*a* of the stacking portion 124. As a result, the sheet bundle P1 stacked on the stacking portion 124 is bent downward and folded as illustrated in FIG. 1A.

The position of the sheet bundle P1 which the pushing rod 129*a* contacts is the stapling position as well as the position where the scoring device 110 has formed the groove portion. Therefore, the sheet bundle P1 can be smoothly and correctly folded.

After the sheet bundle P1 is folded, the dolly 125 returns to the position illustrated in FIGS. 8A and 8B, and the drum 112 rotates 180 degrees. Consequently, a sheet bundle P2 which is remaining on the drum 112 is stacked onto the stacking portion 124. A folding process similar to that performed on the sheet bundle P1 is performed on the sheet bundle P2.

Figure 10A:
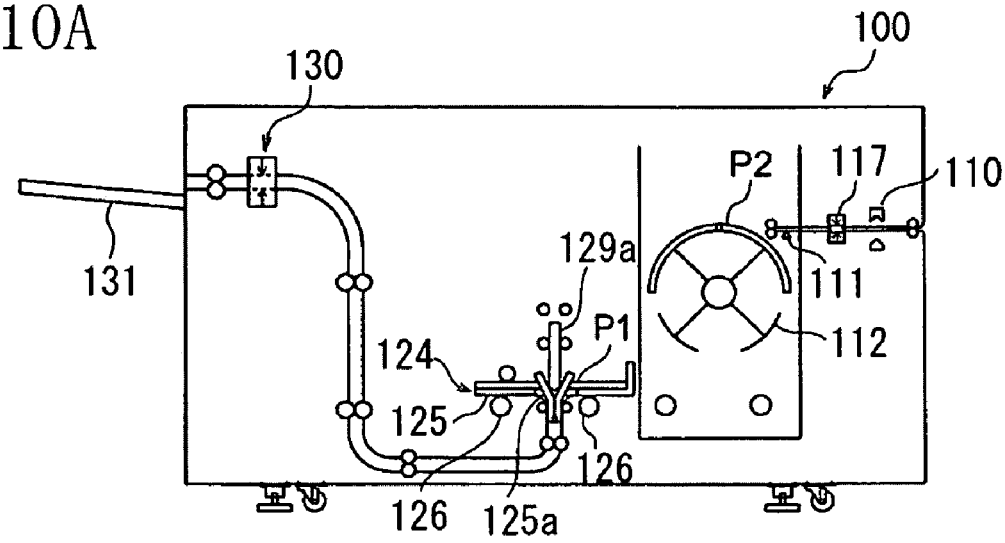
FIGS. 10A and 10B illustrate an example bookbinding operation performed by a bookbinding apparatus according to an exemplary embodiment of the present invention.
Figure 10B:
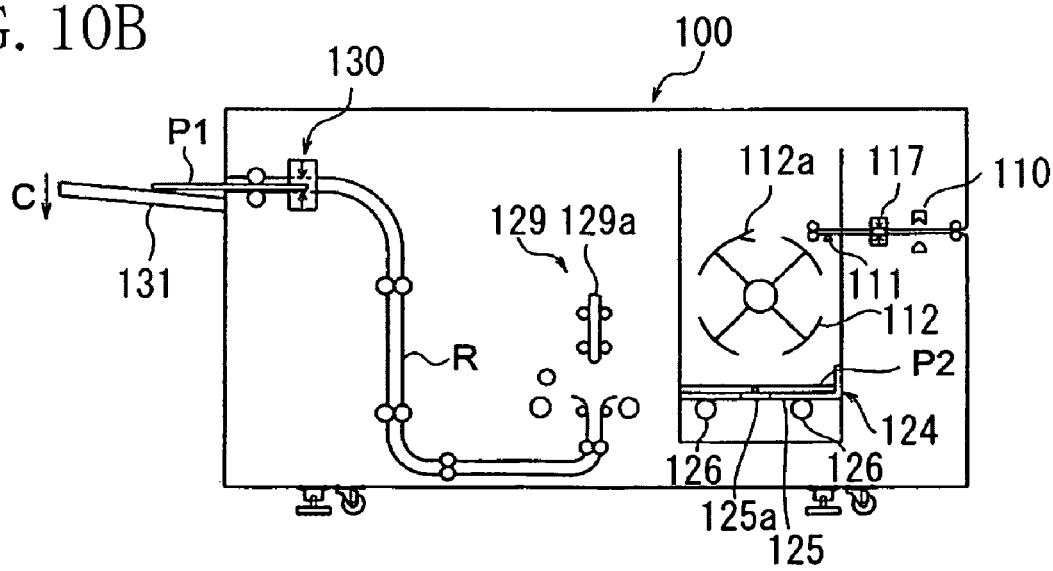

The sheet bundles P1 and P2 are conveyed on the dolly 125 through the conveyance path R illustrated in FIG. 10B, and the dolly 125 stops when the rear ends of the sheet bundles P1, P2 enter the trimming device 130. In step S111, the controller 300 then activates the trimming device 130, and the trimming device 130 trims the rear ends of the sheet bundles P1 and P2. In step S112, the trimmed sheet bundles P1 and P2 are discharged onto a shift tray 131. The shift tray 131 descends in the direction indicated by an arrow C illustrated in FIG. 10B every time the sheet bundles P1 and P2 are discharged, so that the sheet bundles P1 and P2 are sequentially stacked.

Figure 11A:
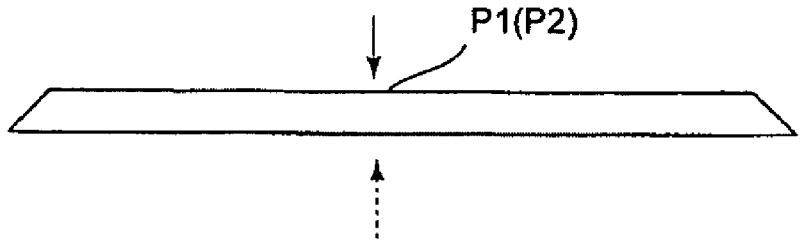
FIGS. 11A, 11B, and 11C illustrate an example folding process performed by a folding unit included in a bookbinding apparatus according to an exemplary embodiment of the present invention.

FIG. 11A illustrates the sheet bundle P1 (P2) that is dropped onto the stacking portion 124. In a case where the continuous sheet P wrapped around a cylindrical drum is cut perpendicularly to a tangent line to the periphery of the drum, the cut sheet bundle P1 (P2) is shaped proximately like a trapezoid. This is caused by the difference between the inner and outer diameters of the sheet bundle that is wrapped around the cylindrical drum a predetermined number of times. Further, when the trimming device 130 trims the sheet bundles P1 and P2 to align the rear ends of the sheet bundles, the cutting direction of the trimming device 130 is perpendicular to the sheet surface, to improve the appearance of the sheet bundles.

Figure 11B:
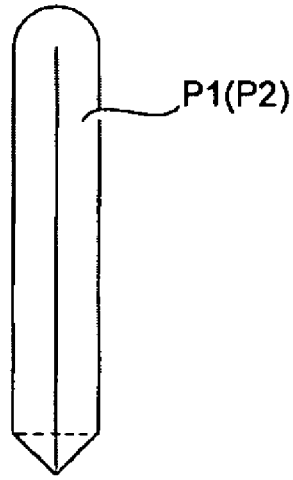

If the sheet bundle P1 (P2) with a trapezoidal shape is folded in the direction of the dotted arrow, the edge of the folded sheet bundle P1 (P2) becomes sharp, as illustrated in FIG. 11B. In a case where the rear ends of the sheet bundles P1 and P2 are trimmed in such a state, the edges are trimmed at the position indicated by the dotted line illustrated in FIG. 11B.

On the other hand, in the present exemplary embodiment, the sheet bundle P1 (P2) is folded in the direction of the solid arrow illustrated in FIG. 11A. That is, the sheet bundle P1 (P2) is folded in a direction from the inner periphery to the outer periphery of the sheet bundle P1 (P2) when the sheet bundle P1 (P2) is wound by the drum.

Figure 11C:
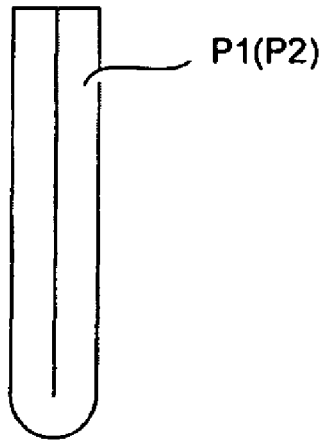
Figure 12:
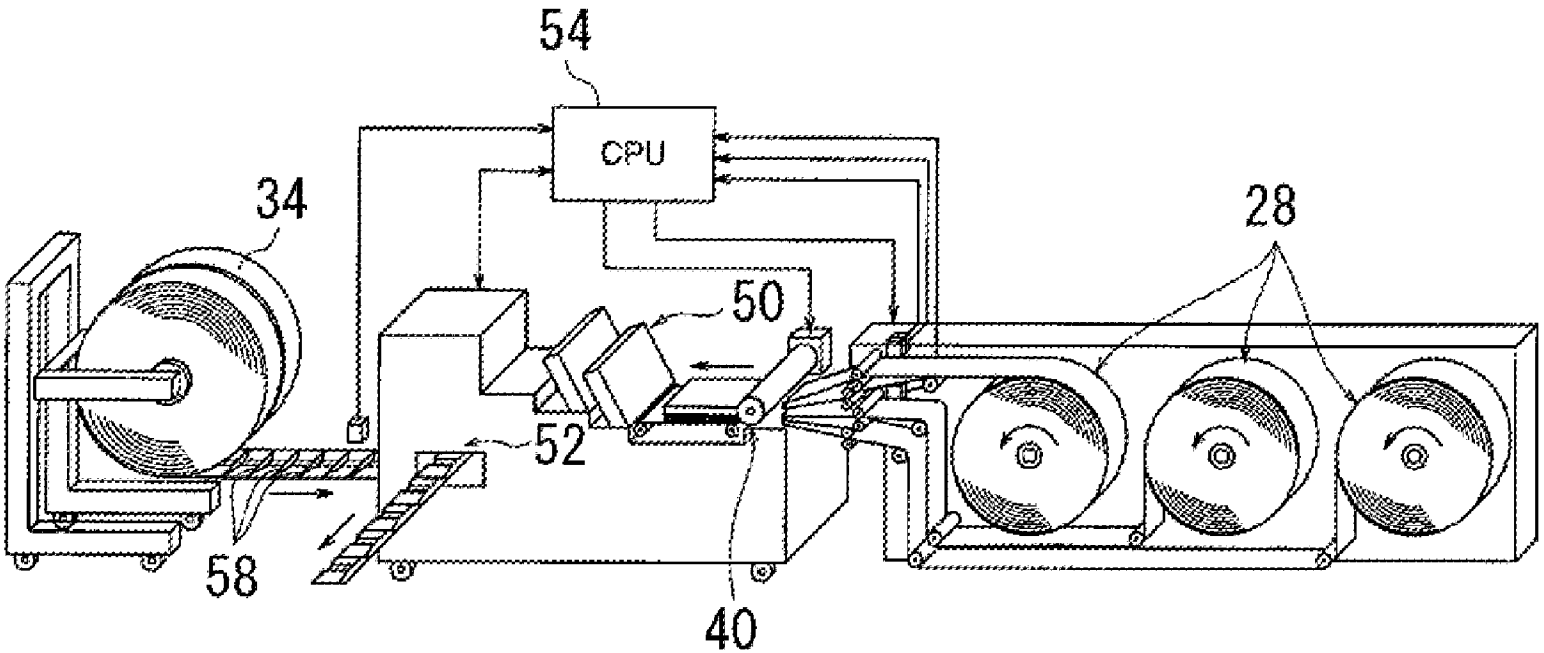
FIG. 12 illustrates an example configuration of a conventional sheet processing apparatus.

The edge of the sheet bundle P1 (P2) that is folded in the above-described direction does not become sharp. Instead, the edge becomes nearly flat as illustrated in FIG. 11C, so that there is hardly any portion to be trimmed.

As described above, an amount trimmed by the trimming device 130 which performs the final process of the sheet bundle can be small by folding the sheet bundle P1 (P2) in the direction from the inner periphery to the outer periphery of the sheet bundle P1 (P2) when the sheet bundle P1 (P2) is wound on the drum. The trimming process by the trimming device 130 can be omitted in a case where a simple booklet such as a pamphlet is created. As a result, the amount of cutting wastage can be reduced, and the amount of continuous sheet to be used can be reduced.

As described above, according to the present exemplary embodiment, a continuous sheet is wrapped around a drum and then cut out as a bundle. As a result, the bookbinding process can be performed much faster and productivity is improved as compared to cutting one sheet at a time. Further, the sheet bundle is folded in the direction from the inner periphery to the outer periphery of the continuous sheet bundle wound by the drum, so that the amount of trimming can be reduced, or the trimming process can be omitted.

In the above-described exemplary embodiment, the image forming apparatus main body 102 is an analog apparatus which scans an original by an exposing device and forms an image on the photosensitive drum 105. However, the present invention is not limited to such an analog apparatus. The present invention can be applied to a digital apparatus which irradiates the photosensitive drum 105 with a laser beam according to the read original image information to form the image on the photosensitive drum 105.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2007-111304 filed Apr. 20, 2007 and No. 2008-095500 filed Apr. 1, 2008, which are hereby incorporated by reference herein in its entirety.

What is claimed is:

1. A sheet processing apparatus comprising:

a winding unit configured to wind a continuous sheet;

a binding unit configured to bind the continuous sheet that is wound by the winding unit;

a cutting unit configured to cut the continuous sheet that is bound by the binding unit in a state that the continuous sheet is wound by the winding unit; and a folding unit configured to fold a sheet bundle formed by cutting with the cutting unit in two at a binding position on the sheet bundle bound by the binding unit, wherein the sheet bundle is folded by the folding unit in a direction from an inner periphery to an outer periphery of the sheet bundle that is wound by the winding unit.

2. The sheet processing apparatus according to claim 1, further comprising:

a trimming unit configured to cut an edge opposite to the binding position of the sheet bundle which is folded in two by the folding unit.

3. The sheet processing apparatus according to claim 2, wherein a cutting direction of the trimming unit is perpendicular to a sheet surface of the sheet bundle that is folded in two.

4. The sheet processing apparatus according to claim 1, further comprising:

a scoring unit configured to form a crease on a position to be folded by the folding unit.

5. The sheet processing apparatus according to claim 1, wherein the binding unit binds the continuous sheet at plural binding positions, and wherein the cutting unit cuts the continuous sheet at positions between the binding positions to form plural sheet bundles.

6. The sheet processing apparatus according to claim 1, wherein the winding unit includes a drum member that winds a sheet on an outer periphery thereof, and wherein the cutting unit cuts the continuous sheet in a direction that is perpendicular to a tangent line to the periphery of the drum member.

7. The sheet processing apparatus according to claim 1, wherein the winding unit includes a drum member that winds a sheet on an outer periphery thereof, and wherein an outer diameter of the drum member is adjustable according to a size of the sheet to be cut.

8. An image forming system comprising:

an image forming apparatus configured to continuously form images on the continuous sheet by setting an interval of a predetermined length; and a sheet processing apparatus configured to process a sheet on which the image forming apparatus forms images, the sheet processing apparatus comprising:

a winding unit configured to wind a continuous sheet;

a binding unit configured to bind the continuous sheet that is wound by the winding unit;

a cutting unit configured to cut the continuous sheet that is bound by the binding unit in a state that the continuous sheet is wound by the winding unit; and a folding unit configured to fold a sheet bundle formed by cutting with the cutting unit in two at a binding position on the sheet bundle bound by the binding unit, wherein the sheet bundle is folded by the folding unit in a direction from an inner periphery to an outer periphery of the sheet bundle that is wound by the winding unit.

9. The image forming system according to claim 8, the sheet processing apparatus further comprising:

a trimming unit configured to cut an edge opposite to the binding position of the sheet bundle which is folded in two by the folding unit.

10. The image forming system according to claim 9, wherein a cutting direction of the trimming unit is perpendicular to a sheet surface of the sheet bundle that is folded in two.

11. The image forming system according to claim 8, the sheet processing apparatus further comprising:

a scoring unit configured to form a crease on a position to be folded by the folding unit.

12. The image forming system according to claim 8, wherein the binding unit binds the continuous sheet at plural binding positions, and wherein the cutting unit cuts the continuous sheet at positions between the binding positions to form plural sheet bundles.

13. The image forming system according to claim 8, wherein the winding unit includes a drum member that winds a sheet on an outer periphery thereof, and wherein the cutting unit cuts the continuous sheet in a direction that is perpendicular to a tangent line to the periphery of the drum member.

14. The sheet processing apparatus according to claim 8, wherein the winding unit includes a drum member that winds a sheet on an outer periphery thereof, and wherein an outer diameter of the drum member is adjustable according to a size of the sheet to be cut.

15. The image forming system according to claim 8, wherein the cutting unit cuts a sheet at the interval.

* * * * *